US006489737B2

(12) United States Patent
Kimiya et al.

(10) Patent No.: US 6,489,737 B2
(45) Date of Patent: Dec. 3, 2002

(54) CATHODE RAY TUBE APPARATUS

(75) Inventors: Junichi Kimiya, Kumagaya (JP); Shunji Ookubo, Kumagaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 09/910,875

(22) Filed: Jul. 24, 2001

(65) Prior Publication Data

US 2002/0047666 A1 Apr. 25, 2002

(30) Foreign Application Priority Data

Jul. 26, 2000 (JP) ..... 2000-225812

(51) Int. Cl.[7] ..... G09G 1/04; H01J 29/50
(52) U.S. Cl. ..... 315/382; 313/414
(58) Field of Search ..... 315/1, 3, 3.5, 327, 315/328, 334, 382; 313/411, 414, 415

(56) References Cited

U.S. PATENT DOCUMENTS 5,262,702 A * 11/1993 Shimoma et al. ..... 313/414
5,449,983 A * 9/1995 Sugawara et al. ..... 313/414
5,663,609 A * 9/1997 Kamohara et al. ..... 313/412
6,225,765 B1 * 5/2001 Yatsu et al. ..... 313/414
6,304,026 B1 * 10/2001 Nakamura et al. ..... 313/409
6,339,300 B2 * 1/2002 Yatsu et al. ..... 313/414
6,400,105 B2 * 6/2002 Uchida et al. ..... 313/414
6,404,149 B1 * 6/2002 Ueno et al. ..... 313/412
6,424,084 B1 * 7/2002 Kimiya et al. ..... 313/412

FOREIGN PATENT DOCUMENTS

JP 64-38947 2/1989

* cited by examiner

*Primary Examiner*—Don Wong
*Assistant Examiner*—Minh D A
(74) *Attorney, Agent, or Firm*—Oblon, Spivak, McClelland, Maier & Neustadt, P.C.

(57) ABSTRACT

An electric field expansion type main lens portion is constituted by including a focus electrode to which a focus voltage on a first level is applied, an anode electrode to which an anode voltage on a second level higher than the first level is applied, and two auxiliary electrodes to which a voltage on a third level higher than the first level and lower than the second level is applied and which are arranged between the focus electrode and the anode electrode. An electrode length of each of the two auxiliary electrodes along an electron beam traveling direction is constituted so as to differ in accordance with a difference in potential between electrodes arranged at front and rear positions in the electron beam traveling direction of each auxiliary electrode.

10 Claims, 4 Drawing Sheets

CATHODE RAY TUBE APPARATUS

CROSS-REFERENCE TO RELATED APPLICATIONS

This application is based upon and claims the benefit of priority from the prior Japanese Patent Application No. 2000-225812, filed Jul. 26, 2000, the entire contents of which are incorporated herein by reference.

BACKGROUND OF THE INVENTION

1. Field of the Invention

The present invention relates to a cathode ray tube apparatus, and more particularly to a cathode ray tube apparatus provided with an electron gun structure having an electric field expansion type main lens with a large diameter.

2. Description of the Related Art

In recent years, demands for realizing the high resolution of a cathode ray tube apparatus has been increased, and a beam spot diameter on a phosphor screen which is a large factor for determining the resolution is determined by the focusing performance of an electron gun structure for emitting electron beams.

This focusing performance is generally determined by a diameter of a main lens, a virtual object image diameter relative to the main lens, the magnification of the main lens and others. That is, the beam spot diameter can be decreased as the diameter of the main lens is increased, as the virtual object image diameter is reduced and as the magnification of the main lens is reduced, thereby improving the resolution.

For example, as shown in FIGS. 5 and 6, there is known an electron gun structure having an electric field expansion type main lens with a large diameter. This electron gun structure includes two intermediate electrodes Gm1 and Gm2 arranged between a focus electrode G5 and an anode electrode G6. An electric field between the focus electrode G5 to the anode electrode G6 is expanded in a traveling direction of electron beams by applying a potential between the focus electrode G5 and the anode electrode G6 to the intermediate electrodes Gm1 and Gm2.

As described above, the main lens in this electron gun structure expands an electric field in the main lens along the electron beam traveling direction and forms the gentle potential gradient, thereby constituting a long-focusing lens. As a result, the beam spot diameter on the phosphor screen is decreased, and the resolution is improved.

Jpn. Pat. Appln. KOKAI Publication No. 64-38947 discloses an electron gun structure including two intermediate electrodes. In this electron gun structure, an application voltage of the focus electrode is approximately 6 kV to 9 kV, and an application voltage of the anode electrode is approximately 25 kV to 30 kV.

A voltage which is approximately 40% of the anode voltage is applied to a first intermediate electrode arranged on the focus electrode side, and a voltage which is approximately 65% of the anode voltage is applied to a second intermediate electrode arranged on the anode electrode side. These two intermediate electrodes are constituted in such a manner that their electrode lengths in the electron beam traveling direction are equal to each other.

However, in order to sufficiently exploit the characteristic of such an electric field expansion type main lens, the electrode length of each electrode, an opening diameter and the potential distribution thereof must be appropriately set. In the above-described structure, however, the density of the potential gradient differs in the vicinity of the first intermediate electrode and the second intermediate electrode.

That is, a difference in potential between the electrodes on the both sides of the first intermediate electrode, namely, a difference between voltages applied to the focus electrode and the second intermediate electrode (assuming that the focus voltage is 25% of the anode voltage, a difference in potential is 65%−25%=40%) dominantly acts on the electric field in the vicinity of the first intermediate electrode. Further, a difference in potential between the electrodes on the both sides of the second intermediate electrode, namely, a difference between voltages applied to the anode electrode and the first intermediate electrode (a difference in potential is 100%−40%=60%) dominantly acts on the electric field in the vicinity of the second intermediate electrode. Thus, when the electrode length of each of the first intermediate electrode and the second intermediate electrode and a distance between these electrodes are equal to each other, the density of the potential gradient in the vicinity of the second intermediate electrode becomes stronger than that of the potential gradient in the vicinity of the first intermediate electrode. Therefore, the potential gradient constituting the electric field expansion lens becomes locally uneven.

In order to make the electric field expansion type lens to function as a lens with a larger diameter (long-focusing lens), the electric field expansion type lens must be constituted as if it is a part of the central axis of a large lens. That is, when the potential gradient in the electric field expansion type lens is uniform, the lens with a larger diameter can be obtained, and the aberration component accepted by the electron beams can be further reduced.

Therefore, the electric field expansion type lens having the considerable unevenness in the potential gradient disclosed in the prior art described above can be said that its lens is not constituted as a lens with a sufficiently large diameter.

Furthermore, in the above-mentioned electron gun structure, an opening diameter and an electrode length of each intermediate electrode are not explicitly described. However, the appropriate relationship is required for the opening diameter and the electrode length of each of these intermediate electrodes.

For example, if the electrode length is sufficiently long with respect to the opening diameter of the intermediate electrode, the following problem occurs. That is, as shown in FIG. 4, when the electrode length L1 is long with respect to the opening diameter Φ to some extent, the discontinuity is produced in the potential gradient in the vicinity of the center of that intermediate electrode. Therefore, the gentle potential gradient formed from the focus electrode to the anode electrode is interrupted in the vicinity of the center of that intermediate electrode. The electric field expansion type lens having such discontinuity can be also said that its lens is not constituted as a lens with a sufficiently large diameter.

As described above, in the prior art electron gun structure, since the opening diameter and the electrode length of each electrode constituting the electric field expansion type lens and a distance between the respective electrodes are not appropriately set, the potential gradient constituting the electric field expansion type lens becomes uneven or the potential gradient is interrupted. Therefore, there occurs a problem that the lens with a sufficiently large diameter can not be constituted.

BRIEF SUMMARY OF THE INVENTION

In view of the above-described problems, it is an object of the present invention to provide a cathode ray tube apparatus which can fully bring out a lens characteristic of the electric field expansion type main lens and obtain an excellent image characteristic in the entire phosphor screen.

In order to solve the above-described problem and achieve this aim, there is provided a cathode ray tube apparatus according to claim 1, comprising:

an electron gun structure having an electron beam formation portion for generating at least one electron beam and a main lens portion for focusing an electron beam generated from the electron beam formation portion onto a phosphor screen; and a deflecting yoke for generating a deflecting magnetic field for deflecting an electron beam emitted from the electron gun structure in the horizontal direction and the vertical direction, wherein the main lens portion is constituted by including: at least one focus electrode to which a focus voltage on a first level is applied; at least one anode electrode to which an anode voltage on a second level higher than the first level is applied; and at least two auxiliary electrodes to which a voltage whose level is higher than the first level and lower than the second level is applied, and wherein an electrode length of each of at least two auxiliary electrodes along a traveling direction of the electron beam differs in accordance with a difference in potential between electrodes arranged at front and rear positions in an electron beam traveling direction of each electrode.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A preferred embodiment of a cathode ray tube apparatus according to the present invention will now be described with reference to the accompanying drawings.

Figure 3:
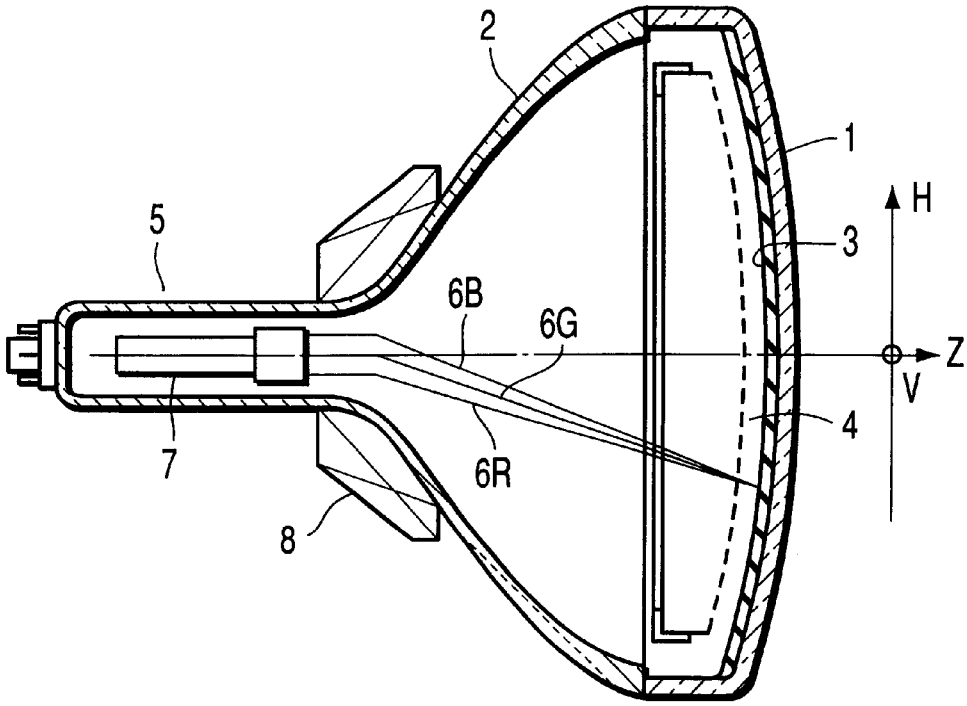
FIG. 3 is a horizontal cross-sectional view schematically showing a structure according to one embodiment of the cathode ray tube apparatus of the present invention.
Figure 4:
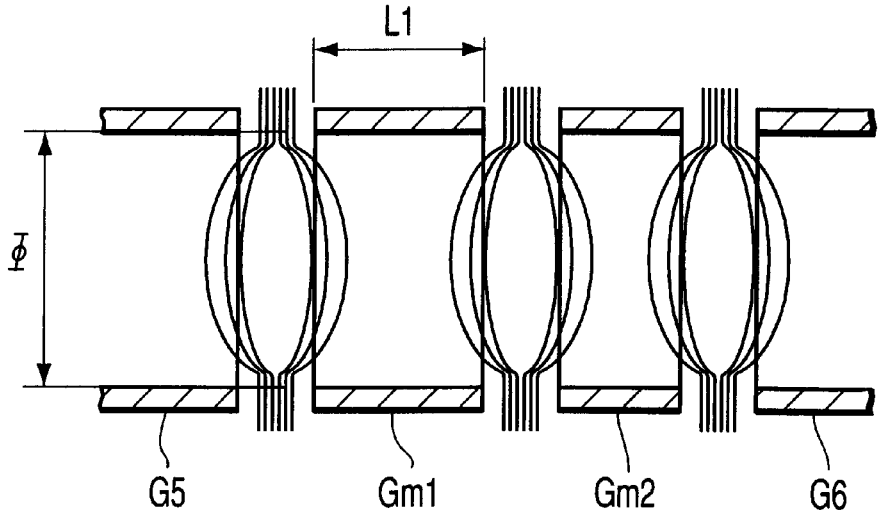
FIG. 4 PRIOR ART
FIG. 4 is a view for explaining discontinuity of an electric field in the electric field expansion type main lens in a prior art electron gun structure.
Figure 5:
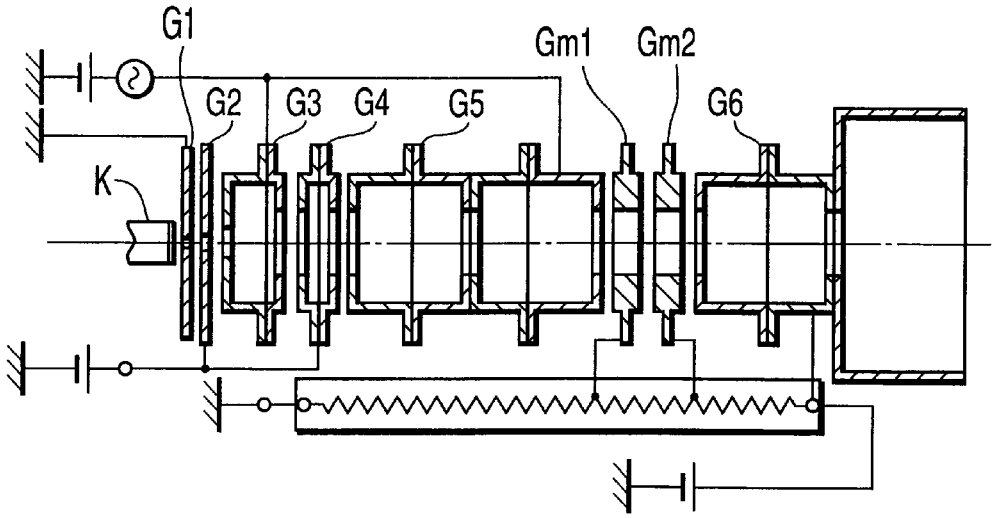
FIG. 5 PRIOR ART
FIG. 5 is a view schematically showing an example of the prior art electron gun structure.
Figure 6:
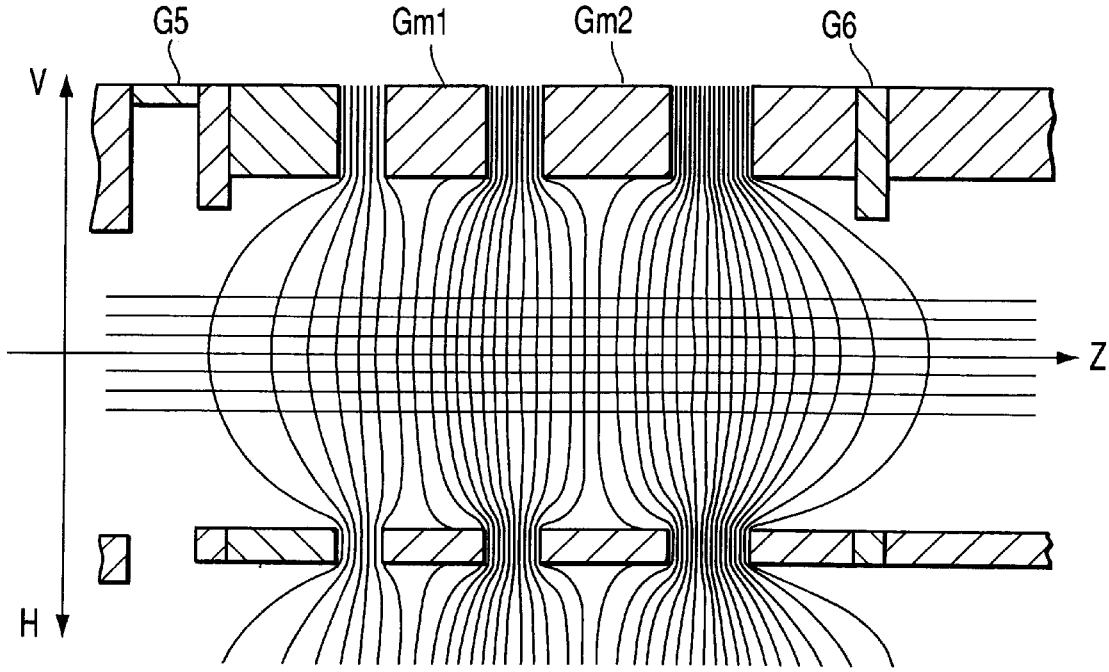
FIG. 6 PRIOR ART
FIG. 6 is a view for explaining discontinuity of the electric field in the electric field expansion type main lens of the electron gun structure shown in FIG. 5.

As shown in FIG. 3, a cathode ray tube apparatus according to the present invention, for example, a color cathode ray tube apparatus has an envelope consisting of a panel 1 and a funnel 2 integrally joined to the panel 1. The panel 1 is provided with a phosphor screen 3 (target) consisting of stripe type or dot type three-color phosphor layers which emit light rays of blue (B), green (G) and red (R), respectively, the phosphor screen 3 being arranged on the inner surface of the panel 1. A shadow mask 4 is attached so as to be opposed to the phosphor screen 3. The shadow mask 4 has multiple apertures on the inner side thereof.

A neck 5 includes an inline type electron gun structure 7 provided inside thereof. This inline type electron gun structure 7 emits three electron beams 6B, 6G and 6R arranged in a line in the horizontal direction H toward a phosphor screen 3, the three electron beams being a center beam 6G passing on the same horizontal plane and a pair of side beams 6B and 6R on the both sides of the center beam 6G. Further, this inline type electron gun structure 7 causes self-convergence of the three electron beams in the center of the phosphor screen 3 by decentering the central positions of side beam passage holes of a low-voltage side grid and a high-voltage side grid constituting a main lens portion.

A deflecting yoke 8 is attached on the outside of the funnel 2. This deflecting yoke 8 generates a non-uniform deflection magnetic field for deflecting the three electron beams 6B, 6G and 6R emitted from the electron gun structure 7 in the horizontal direction H and the vertical direction V. This non-uniform deflection magnetic field is formed by a pin cushion type horizontal deflection magnetic field and a barrel type vertical deflection magnetic field.

The three electron beams 6B, 6G and 6R emitted from the electron gun structure 7 are focused onto the corresponding phosphor layers on the phosphor screen 3 while being subjected to self-convergence toward the phosphor screen 3. The three electron beams 6B, 6G and 6R are then scanned in the horizontal direction H and the vertical direction V of the phosphor screen 3 by a non-uniform deflection magnetic field. As a result, a color image is displayed.

Figure 1:
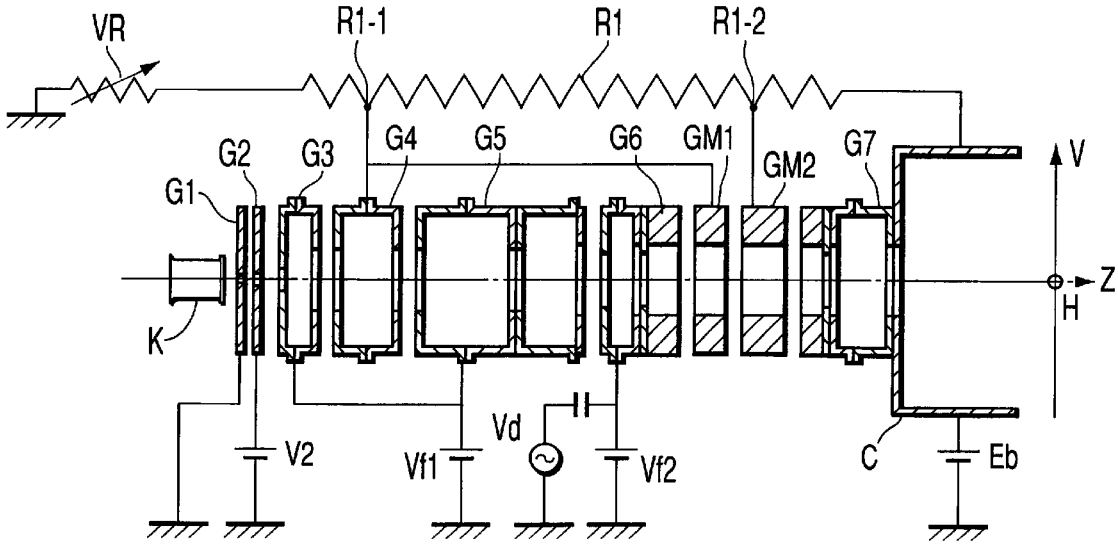
FIG. 1 is a vertical cross-sectional view schematically showing a structure of an electron gun structure applied to a cathode ray tube apparatus according to the present invention.

As shown in FIG. 1, the electron gun structure 7 applied to this cathode ray tube apparatus includes: a cathode K; a first grid G1; a second grid G2; a third grid G3; a fourth grid G4; a fifth grid G5; a sixth grid G6 (focus electrode); a seventh grid GM1 (first auxiliary electrode); an eighth grid GM2 (second auxiliary electrode); a ninth grid G7 (anode electrode); and a convergence cup C. The cathode K, the nine grids and the convergence cup C are arranged along the traveling direction of the electron beams in the mentioned order, and supported and fixed by insulating supports (not shown).

The first grid G1 is grounded (or has a minus potential V1 applied thereto). To the second grid G2 is applied an accelerating voltage V2 having a low potential. This accelerating voltage V2 is approximately 500 V to 800 V.

The third grid G3 and the fifth grid G5 are connected to each other in the tube and a constant first focus voltage Vf1 is supplied to these grids from the outside of the cathode ray tube. The first focus voltage Vf1 is a voltage corresponding to approximately 25% of a later-described anode voltage Eb, and is approximately 6 to 8 kV for example.

To the sixth grid G6 is supplied from the outside of the cathode ray tube a dynamic focus voltage (Vf2+Vd) in which an alternating voltage component Vd synchronized with a deflection magnetic field generated by the deflecting yoke is superposed on a second focus voltage Vf2 which is substantially equal to the first focus voltage Vf1 . As similar to the first focus voltage Vf1 , the second focus voltage Vf2 is a voltage corresponding to approximately 25% of the anode voltage Eb, and is approximately 6 to 8 kV for example. Further, the alternating voltage Vd fluctuates from 0V to 300 to 1500 V in synchronization with the deflection magnetic field.

The ninth grid G7 and the convergence cup C are connected to each other, and the anode voltage Eb is supplied to them from the outside of the cathode ray tube. This anode voltage Eb is approximately 25 to 35 kV.

A resistor R1 is provided in the vicinity of the electron gun structure 7 as shown in FIG. 1. One end of the resistor R1 is connected to the ninth grid G7, and the other end of the same is grounded through a variable resistor VR provided outside the tube (or it maybe directly grounded). The resistor R1 has at its substantially middle portion voltage supply terminals R1-1 and R1-2 for supplying the voltage to the grids of the electron gun structure 7.

The fourth grid G4 and the seventh grid GM1 are connected to each other in the tube and also connected to the voltage supply terminal R1-1 on the resistor R1 in the vicinity of the fourth grid G4. To the fourth grid G4 and the seventh grid GM1 is supplied a voltage obtained by subjecting the anode voltage Eb to resistance division, e.g., a voltage of approximately 40% of the anode voltage Eb through the voltage supply terminal R1-1.

The eighth grid GM2 is connected to the voltage supply terminal R1-2 on the resistor R1 in the vicinity thereof. To the eighth grid GM2 is supplied a voltage obtained by subjecting the anode voltage Eb to resistance division, e.g., a voltage of approximately 60% of the anode voltage Eb through the voltage supply terminal R1-2.

The first grid G1 is a thin plate-like electrode and has three circular electron beam passage holes each of which has a small diameter (for example, circular holes each having a diameter of approximately 0.30 to 0.40 mm) and is formed by boring the plate surface.

The second grid G2 is a thin plate-like electrode and has three circular electron beam passage holes each of which has a diameter slightly larger than the bore diameter formed to the first grid G1 (for example, circular holes each having a diameter of approximately 0.35 to 0.45 mm)

The third grid G3 is formed by causing opening ends of two cup-like electrodes elongated in the tube axis direction Z to abut each other. The end surface of the cup-like electrode opposed to the second grid G2 has three slightly larger electron beam passage holes (for example, circular holes each having a diameter of approximately 1.0 to 1.5 mm). The end surface of the cup-like electrode opposed to the fourth grid G4 has three circular electron beam passage holes (for example, circular holes each having a diameter of approximately 3.0 to 4.1 mm) each having a large diameter.

The fourth grid G4 is formed by causing opening ends of two cup-like electrode elongated in the tube axis direction Z to abut each other. The end surface of the cup-like electrode opposed to the third grid G3 has three circular electron beam passage holes with a large diameter (for example, circular holes each having a diameter of approximately 3.0 to 4.1 mm). Furthermore, the end surface of the cup-like electrode opposed to the fifth grid G5 has three circular electron beam passage holes each having a large diameter (for example, circular holes each having a diameter of approximately 3.0 to 4.1 mm).

The fifth grid G5 is constituted by three cup-like electrodes elongated in the tube axis direction Z and one plate-like electrode. Opening ends of the two cup-like electrode on the fourth grid G4 side abut each other, and an opening end of the cup-like electrode on the sixth grid G6 side abuts on the thin plate-like electrode. The end surface of each of the three cup-like electrodes has three electron beam passage holes each having a large diameter (for example, circular holes each having a diameter of approximately 3.0 to 4.1 mm). The plate surface of the plate-like electrode opposed to the seventh grid G7 has three vertically long electron beam passage holes extended in the vertical direction V (for example, the horizontal diameter/the vertical diameter=4.0 mm/4.5 mm).

The sixth grid G6 is constituted by two cup-like electrodes each having a short length in the tube axis direction Z and two plate-like electrodes. Opening ends of the two cup-like electrodes on the fifth grid G5 side abut each other, and an opening end of the cup-like electrode on the seventh grid GM1 side abut on the thin plate-like electrode, and this thin plate-like electrode abut on a thick plate-like electrode.

The end surface of the cup-like electrode opposed to the fifth grid G5 has three horizontally long (for example, the horizontal diameter/the vertical diameter=4.52 mm/3.0 mm) electron beam passage holes extended in the horizontal direction H. The end surface of the cup-like electrode on the seventh grid GM1 has three circular electron beam passage holes each having a large diameter (for example, circular holes each having a diameter of approximately 4.34 mm). The plate surface of the thin plate-like electrode has three horizontally long (for example, the horizontal diameter/the vertical diameter=4.34 mm/3.0 mm) electron beam passage holes extended in the horizontal direction H. The plate surface of the thick plate-like electrode opposed to the seventh grid GM1 has three circular electron beam passage holes each having a large diameter (for example, circular holes each having a diameter of approximately 4.34 mm).

The seventh grid GM1 and the eighth grid GM2 are constituted by thick plate-like electrodes. The plate surface of the plate-like electrode constituting the seventh grid GM1 has three circular electron beam passage holes each having a large diameter (for example, circular holes each having a diameter of approximately 4.34 mm). The electrode length of the seventh grid GM1 is approximately 1.5 mm. The plate surface of the plate-like electrode constituting the eighth grid GM2 has three circular electron beam passage holes each having a large diameter (for example, circular holes each having a diameter of approximately 4.40 mm). The electrode length of the eighth grid GM2 is approximately 2.0 mm.

The ninth grid G7 is constituted by two plate-like electrodes and two cup-like electrodes. The thick plate-like electrode opposed to the eighth grid GM2 abuts on the thin plate-like electrode. Further, the thin plate-like electrode abuts on the end surface of the cup-like electrode, and opening ends of the two cup-like electrodes abut on each other.

The plate surface of the thick plate-like electrode opposed to the eighth grid GM2 has three circular electron beam passage holes each having a large diameter (for example, circular holes each having a diameter of approximately 4.46 mm). The electrode length of this thick plate electrode is approximately 0.6 to 1.0 mm. The thin plate-like electrode has three circular electron beam passage holes each of which has a horizontally long shape extended in the horizontal direction H (for example, the horizontal diameter/the vertical diameter=4.46 mm/3.2 mm) and a large diameter. Alternatively, the shape of a side beam passage hole may be a sector form in which the vertical diameter on the outer side is larger than the vertical diameter on the center beam passage hole side. The end surface of each of the two cup-like electrodes has three circular electron beam passage holes each having a large diameter (for example, circular holes each having a diameter of approximately 4.46 to 4.52 mm).

The end surface of the convergence cup C abuts against the end surface of the cup-like electrode of the ninth grid G7. The end surface of the convergence cup C has three circular electron beam passage holes each having a large diameter (for example, circular holes each having a diameter of approximately 4.46 to 4.52 mm).

As to the three electron beam passage holes formed between the first grid G1 to the surface of the sixth grid G6 opposed to the fifth grid G5, a distance between centers of the center beam passage hole through which the center beam passes and the side beam passage hole through which the side beam passes is, for example 4.92 mm. On the surface of the sixth grid G6 opposed to the seventh grid GM1, a distance between centers of the center beam passage hole and the side beam passage hole is approximately 4.74 mm.

A distance between centers of the center beam passage hole and the side beam passage hole in the seventh grid GM1 is approximately 4.74 mm. A distance between centers of the center beam passage hole and the side beam passage hole in the eighth grid GM2 is approximately 4.80 mm. On the surface of the ninth grid G7 opposed to the eighth grid GM2, a distance between centers of the center beam passage hole and the side beam passage hole is approximately 4.88 mm.

Each of the electrode gap between the sixth grid G6 and the seventh grid GM1, the electrode gap between the seventh grid GM1 and the eighth grid GM2 and the electrode gap between the eighth grid GM2 and the ninth grid G7 is set to approximately 0.6 mm.

In the electron gun structure having the above-described structure, the electron beam formation portion is formed by the cathode K, the first grid G1 and the second grid G2. A pre-focus lens is formed by the second grid G2 and the third grid G3 and preliminary focuses the electron beams generated from the electron beam formation portion.

A sub lens is formed by the third grid G3, the fourth grid G4 and the fifth grid G5 and further preliminary focuses the electron beams which have been preliminary focused by the pre-focus lens.

A quadrupole lens whose lens intensity varies by a dynamic focus voltage (Vf2+Vd) which fluctuates in accordance with a deflection quantity of the electron beams is formed between the fifth grid G5 and the sixth grid G6.

The main lens is formed by the sixth grid G6, the seventh grid GM1, the eighth grid GM2 and the ninth grid G7 and finally focuses the preliminary focused electron beams onto the phosphor screen.

Between the sixth grid G6 and the seventh grid GM1 forming the main lens is formed a non-axial-symmetrical lens (second non-axial-symmetrical lens) whose lens intensity varies by the dynamic focus voltage (Vf2+Vd) which fluctuates in accordance with a deflection quantity of the electron beams and also differs in the horizontal direction H and the vertical direction V. This non-axial-symmetrical lens relatively has the focusing lens action in the vertical direction V and the divergence lens action in the horizontal direction H.

Furthermore, between the eighth grid GM2 and the ninth grid G7 constituting the main lens is formed a non-axial-symmetrical lens (first non-axial-symmetrical lens) whose lens intensity differs in the horizontal direction H and the vertical direction V. This non-axial-symmetrical lens relatively has the divergence lens action in the vertical direction V and the focusing lens action in the horizontal direction H.

As described above, the electrode length of each of at least two auxiliary electrodes GM1 and GM2 arranged between the focus electrode G6 and the anode electrode G7 along the traveling direction of the electron beams differs in accordance with a difference in potential between the electrodes arranged at front and rear positions in the electron beam traveling direction of each electrode.

That is, a difference in potential between the sixth grid G6 and the eighth grid GM2 arranged at front and rear positions the seventh grid GM1 corresponds to approximately 35% of the anode voltage since the application voltage to the sixth grid G6 is approximately 25% of the a node voltage and the application voltage to the eighth grid GM2 is approximately 60% of the anode voltage. Moreover, a difference in potential between the seventh grid GM1 and the ninth grid G7 arranged at front and rear positions the eighth grid GM2 corresponds to approximately 60% of the anode voltage since the application voltage to the seventh grid GM1 is approximately 40% of the anode voltage and the application voltage to the ninth grid G7 is 100% of the anode voltage.

On the other hand, the electrode length of the seventh grid GM1 along the electron beam traveling direction is approximately 1.5 mm, and the electrode length of the eighth grid GM2 along the electron beam traveling direction is approximately 2.0 mm.

In other words, of the two auxiliary electrode GM1 and GM2, it is determined that: the electrode length of the first auxiliary electrode GM1 adjacent to the focus electrode G6 along the electron beam traveling direction is L1; the electrode length of the second auxiliary electrode GM2 adjacent to the anode electrode G7 along the electron beam traveling direction is L2; the focus voltage applied to the focus electrode G6 is Vf; the anode voltage applied to the anode electrode G7 is Eb; the voltage applied to the first auxiliary electrode GM1 is Vm1; and the voltage applied to the second auxiliary electrode GM2 is Vm2.

These auxiliary electrodes are constituted so that $L1<L2$ is achieved when a difference in potential between the first auxiliary electrode GM1 and the anode electrode G7 arranged at front and rear positions the second auxiliary electrode GM2 (Eb−Vm1) is larger than a difference in potential between the focus electrode G6 and the second auxiliary electrode GM2 arranged at front and rear positions in the electron beam traveling direction of the first auxiliary electrode GM1 (Vm2−Vf).

In addition, these auxiliary electrodes are constituted so that $L1>L2$ is achieved when a difference in potential between the first auxiliary electrode GM1 and the anode electrode G7 arranged at front and rear positions the second auxiliary electrode GM2 (Eb−Vm1) is smaller than a difference in potential between the focus electrode G6 and the second auxiliary electrode GM2 arranged at front and rear positions in the electrode beam traveling direction of the first auxiliary electrode GM1 (Vm2−Vf).

Figure 2:
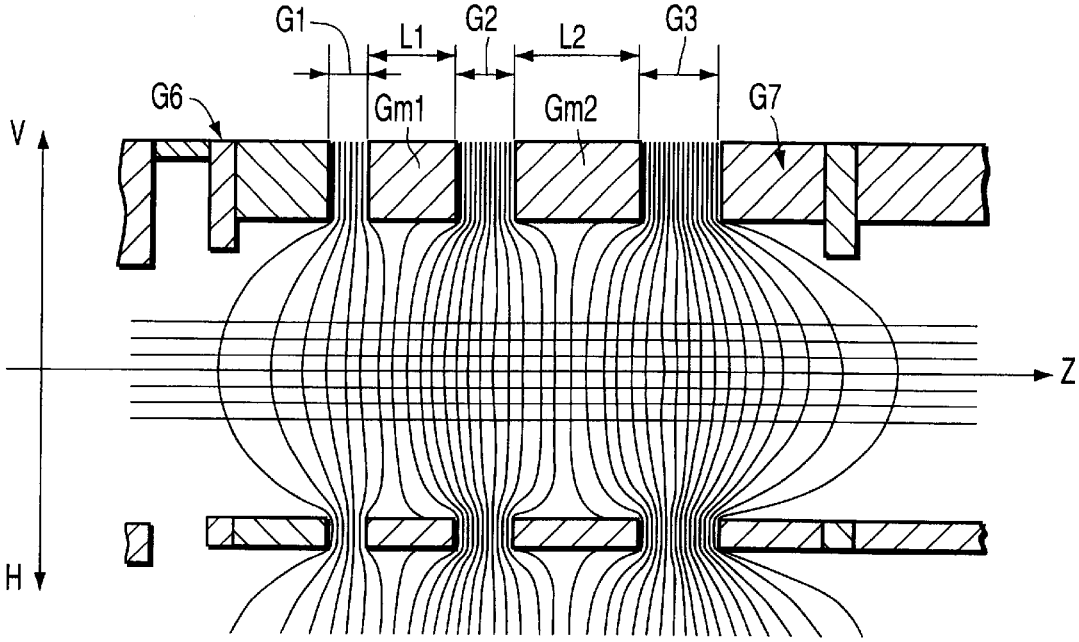
FIG. 2 is a view for explaining the relationship between an electric field distribution constituting an electric field expansion type main lens in the electron gun structure shown in FIG. 1, an electrode length of an auxiliary electrode and an electrode gap.

In this embodiment, as shown in FIG. 2, a difference in potential in the vicinity of the eighth grid GM2 (approximately 60% of the anode voltage) is larger than a difference in potential in the vicinity of the seventh grid GM1 (approximately 35% of the anode voltage) in the vicinity of the seventh grid GM1. In this case, the density of the potential gradient in the vicinity of the eighth grid GM2 is higher than that of the potential gradient in the vicinity of the seventh grid GM1. However, by setting the electrode length of the seventh grid GM1 to approximately 1.5 mm and the electrode length of the eighth grid GM2 to approximately 2.0 mm, namely, by setting the electrode length of the eighth grid GM2 longer than the electrode length of the seventh grid GM1 in the vicinity of the eight grid GM2 where the density of the potential gradient becomes high, the local unevenness of the potential gradient of the electric field expansion type lens formed between the sixth grid G6 and the ninth grid G7 can be alleviated.

In the above-described embodiment, although description has been given as to the case of the two auxiliary electrodes arranged between the focus electrode G6 and the anode electrode G7, a number of the auxiliary electrodes may be two or above.

That is, it is assumed that the respective auxiliary electrodes (x) are Gm1, Gm2, . . . , Gmn, . . . , Gm(x) from the focus electrode G6 side toward the anode electrode G7 side, the voltages applied to the respective auxiliary electrodes are Vm1, Vm2, . . . , Vm(n), . . . , Vm(x), and the electrode lengths of the respective auxiliary electrodes along the electron beam traveling direction are L1, L2, . . . , L(n), . . . , L(x). The electrode length of each auxiliary electrode is determined in accordance with a difference in potential between the electrode arranged at front and rear positions in the electron beam traveling direction in such a manner that that the relationship between L(n) and L(n−1) can be L(n) >L(n−1) when Vm(n+1)−Vm(n−1) Vm(n−1)>Vm(n)−Vm (n−2), and this relationship can be L(n)<L(n−1) when Vm(n+1)−Vm(n−1)<Vm(n)−Vm(n−2) (where n≧2, x ≧2, Vm(0)=Vf, Vm(x+1)=Eb).

Moreover, assuming that a distance including the electrode length L(n) of each auxiliary electrode and distances G(n−1) and G(n) between electrodes arranged at front and rear positions in the electron beam traveling direction of that electrode is D(n), the electrode length of each auxiliary electrode and the distance between electrodes are set in such a manner that the following formula can be attained:

$$1<D(n-1)/D(n)\leqq\{Vm(n)-\mathrm{Vm}(n-2)\}/\{Vm(n+1)-Vm(n-1)\}$$

(where n≧2, x≧2, Vm(0)=Vf, Vm(x+1)=Eb)

As a result, as similar to the above-described example, it is possible to alleviate the local unevenness of the potential gradient of the electric field expansion type lens in which the potential between the focus electrode G6 and the anode electrode G7 is expanded in the electron beam traveling direction.

At the same time, the electrode length of each of the auxiliary electrodes GM1 and GM2 is set so as to be sufficiently smaller than the opening diameter of each auxiliary electrode so that the continuous potential gradient can be obtained without interrupting the electric field which has permeated from each electrode arranged at front and rear positions in the electron beam traveling direction into each auxiliary electrode.

That is, in the seventh grid GM1, the electrode opening diameter, i.e., the diameter Φ of the electron beam passage hole is set to approximately 4.34 mm whilst the electrode length L is set to approximately 1.5 mm. In the eighth grid GM2, the electrode opening diameter, i.e., the diameter Φ of the electron beam passage hole is set to 4.40 mm whilst the electrode length L is set to approximately 2.0 mm. This relationship is set so as to satisfy the following expression:

$$\Phi/L\leqq 0.6$$

(in order to optimize the relationship, 0.3≦Φ/L≦0.6)

As a result, as shown in FIG. 2, it is possible to configure the auxiliary electrodes in such a manner that the electric fields from the respective electrodes arranged at the front and rear positions in the electron beam traveling direction of these auxiliary electrodes GM1 and GM2 permeate inside the respective auxiliary electrodes and the local discontinuity of the potential gradient of the electric field expansion type lens is eliminated without interrupting the electric fields from the respective electrodes.

As described above, according to this cathode ray tube apparatus, the electric field expansion type main lens is constituted by a plurality of auxiliary electrodes which are arranged between the focus electrode and the anode electrode and to which voltages are supplied by subjecting the anode voltage to resistance division by using a resistor arranged in the vicinity of the electron gun structure. This electric field expansion type main lens can eliminate the prominent unevenness and discontinuity of the potential gradient in the lens space thereof. Consequently, the electric field expansion type main lens can be constituted as if it is a part of the central axis of the lens having a larger diameter. Accordingly, the lens characteristic of the electric field expansion type main lens can be fully brought out, and the electron lens with less lens aberration can be obtained.

Therefore, an excellent image characteristic can be obtained in the entire phosphor screen.

Incidentally, since description has been mainly given as to the electron gun structure to be sealed in the neck diameter of 22.5 mm (dimension tolerance: ±0.7) in the above-mentioned embodiment, the electrode opening diameter and others are set relatively smaller. However , the present invention is not restricted thereto, and there occurs no problem in an electron gun model which is sealed in the neck diameter of approximately 29.1 mm and adopts the electrode opening diameter of approximately of 5.5 to 6.2 mm or a larger electrode opening diameter.

Figure 7:
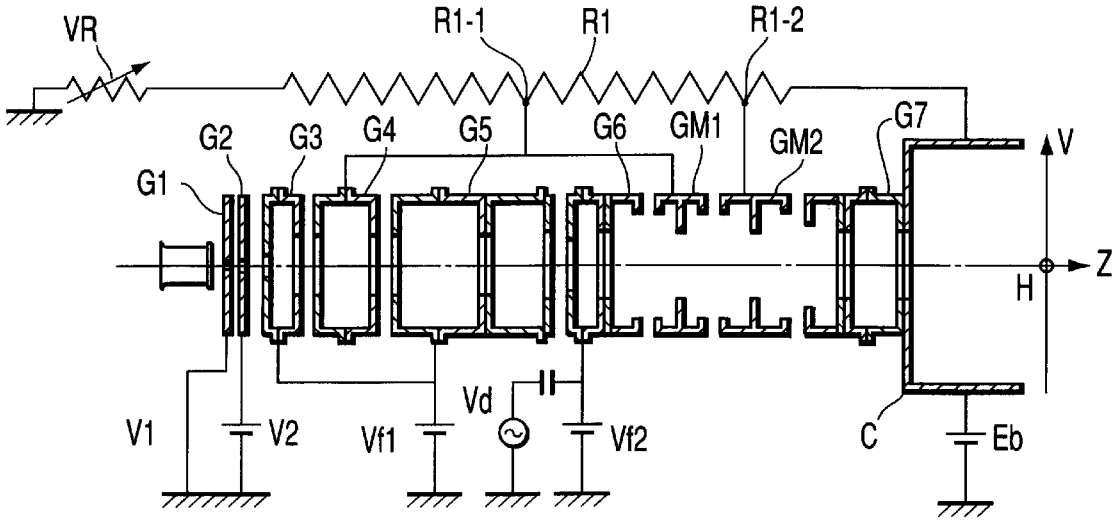
FIG. 7 is a vertical cross-sectional view schematically showing another structure of the electron gun structure applied to the cathode ray tube apparatus according to the present invention.

Further, although the auxiliary electrode according to the above embodiment has been described as one having circular electron beam passage holes, the present invention is not restricted thereto. For example, as shown in FIG. 7, the auxiliary electrodes GM1 and GM2, and the focus electrode G6 and the anode electrode G7 arranged in front of and at the rear of the auxiliary electrodes can be similarly applied in an electron gun model which is of a type having an electrode opening portion common to the three electron beams.

Incidentally, as to the shapes of the electron beam passage holes formed to the two auxiliary electrodes GM1 and GM2, when one has a circular shape, the other one is also formed into a circular shape. Furthermore, when one has the electrode opening portion common to the three electron beams, the other one also has the same shape. As a result, the unevenness and the discontinuity of the potential gradient can be further restricted.

Further, in the foregoing embodiment, as the electron gun model to be sealed in the cathode ray tube apparatus having a deflecting angle of 100 degrees, the voltage applied to the seventh grid GM1 is set to approximately 40% of the anode voltage and the voltage applied to the eighth grid GM2 is set to approximately 60% of the anode voltage. However, the present invention is not restricted thereto. For example, in case of the cathode ray tube apparatus having a deflecting angle of 90 degrees, it may be good to set the voltage applied to the seventh grid GM1 to approximately 35% and the voltage applied to the eighth grid GM2 to approximately 65% of the anode voltage in some cases. As described above, designing the electrode length of the auxiliary electrode to be optimum for the voltage to be applied can fully bring out the lens characteristic of the electric field expansion type main lens.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode ray tube apparatus comprising: an electron gun structure having an electron beam formation portion for generating at least one electron beam and a main lens portion for focusing said electron beam generated from said electron beam formation portion onto a phosphor screen; and a deflecting yoke for generating a deflection magnetic field for deflecting said electron beam emitted from said electron gun structure in the horizontal direction and the vertical direction, wherein said main lens portion is constituted by including at least one focus electrode to which a focus voltage on a first level is applied, at least one anode electrode to which an anode voltage on a second level higher than said first level is applied, and at least two auxiliary electrodes to which a voltage whose level is higher than said first level and lower than said second level is applied, and wherein an electrode length of each of said at least two auxiliary electrodes along a traveling direction of said electron beam differs in accordance with a difference in potential between electrodes arranged at front and rear positions in said electron beam traveling direction of each electrode.

2. The cathode ray tube apparatus according to claim 1, wherein a voltage obtained by subjecting said anode voltage to resistance division by a resistor arranged in the vicinity of said electron gun structure is applied to said at least two auxiliary electrodes.

3. The cathode ray tube apparatus according to claim 1, wherein an electrode length of said auxiliary electrode is sufficiently smaller than an opening diameter of said auxiliary electrode in such a manner that a continuous potential gradient can be obtained without interrupting an electric field which has permeated into said auxiliary electrode from electrodes arranged in front of and at the rear of said auxiliary electrode.

4. The cathode ray tube apparatus according to claim 1, wherein a first non-axial-symmetrical lens whose lens intensity differs in the horizontal direction and the vertical direction is formed between said anode electrode constituting said main lens portion and said auxiliary electrode adjacent to said anode electrode.

5. The cathode ray tube apparatus according to claim 4, wherein said first non-axial-symmetrical lens has a divergence action relatively in the vertical direction and a focusing action relatively in the horizontal direction.

6. The cathode ray tube apparatus according to claim 1, wherein a second non-axial-symmetrical lens whose lens intensity differs in the horizontal direction and the vertical direction is formed between said focus electrode constituting said main lens portion and said auxiliary electrode adjacent to said focus electrode.

7. The cathode ray tube apparatus according to claim 6, wherein said second non-axial-symmetrical lens has a focusing action relatively in the vertical direction and a divergence action relatively in the horizontal direction.

8. A cathode ray tube apparatus comprising: an electron gun structure having an electron beam formation portion for generating at least one electron beam and a main lens portion for focusing said electron beam generated from said electron beam formation portion onto a phosphor screen; and a deflecting yoke for generating a deflection magnetic field for deflecting said electron beam emitted from said electron gun structure in the horizontal direction and the vertical direction, wherein said main lens portion is constituted by including at least one focus electrode to which a focus voltage (Vf) on a first level is applied, at least one anode electrode to which an anode voltage (Eb) on a second level higher than said first level is applied, and at least two auxiliary electrodes to which a voltage whose level is higher than said first level and lower than said second level is applied, these electrodes being arranged along a traveling direction of said electron beam in the order to said at least one focus electrode, said at least two auxiliary electrodes and said at least one anode electrode, and wherein assuming that said respective auxiliary electrode (x) are Gm1, Gm2, . . . , Gmn, . . . , Gm(x) from the focus electrode side toward the anode electrode side, voltages applied to said respective auxiliary electrodes are Vm1, Vm2, . . . , Vm(n), . . . , Vm(x), and electrode lengths of said respective auxiliary electrodes along said electron beam traveling direction are L1, L2, . . . , L(n), . . . , L(x), said electrode lengths of said respective auxiliary electrodes are set in accordance with a difference in potential between electrodes arranged at front and rear positions in said electron beam traveling direction in such a manner that:

the relationship between L(n) and L(n−1) becomes $L(n)>L(n-1)$ when $Vm(n+1)-Vm(n-1)>Vm(n)-Vm(n-2)$; and said relationship becomes $L(n)<L(n-1)$ when $Vm(n+1)-Vm(n-1)<Vm(n)-Vm(n-2)$ (where $n\geqq 2$, $x\geqq 2$, $Vm(0)=Vf$, $Vm(x+1)=Eb$).

9. A cathode ray tube apparatus comprising: an electron gun structure having an electron beam formation portion for generating at least one electron beam and a main lens portion for focusing said electron beam generated from said electron beam formation portion onto a phosphor screen; and a deflecting yoke for generating a deflection magnetic field for deflecting said electron beam emitted from said electron gun structure in the horizontal direction and the vertical direction, wherein said main lens portion is constituted by including at least one focus electrode to which a focus voltage (Vf) on a first level is applied, at least one anode electrode to which an anode voltage (Eb) on a second level higher than said first level is applied, and at least two auxiliary electrodes to which a voltage whose level is higher than said first level and lower than said second level is applied, these electrodes being arranged along a traveling direction of said electron beam in the order to said at least one focus electrode, said at least two auxiliary electrodes, and said at least one anode electrode, and wherein assuming that said respective auxiliary electrode (x) are Gm1, Gm2, . . . , Gmn, . . . , Gm(x) from the focus electrode side toward the anode electrode side, voltages applied to said respective auxiliary electrodes are Vm1, Vm2, . . . , Vm(n), . . . , Vm(x), electrode lengths of said respective auxiliary electrodes along said electron beam traveling direction are L1, L2, . . . , L(n), . . . , L(x), and a distance including each electrode length L(n) and gaps between electrodes arranged at front and rear positions in said electron beam traveling direction of that electrode G(n−1) and G(n) is D(n), the following expression can be obtained:

$$1<D(n-1)/D(n)\geqq\{Vm(n)-Vm(n-2)\}/\{Vm(n+1)-Vm(n-1)\}$$

(where, n≧2, x≧2, Vm(0)=Vf, Vm(x+1)=Eb).

10. A cathode ray tube apparatus comprising: an electron gun structure having an electron beam formation portion for generating at least one electron beam and a main lens portion for focusing said electron beam generated from said electron beam formation portion onto a phosphor screen; and a deflecting yoke for generating a deflection magnetic field for deflecting said electron beam emitted from said electron gun structure in the horizontal direction and the vertical direction, wherein said main lens portion is constituted by including at least one focus electrode to which a focus voltage on a first level is applied, at least one anode electrode to which an anode voltage on a second level higher than said first level is applied, and two auxiliary electrodes to which voltages on third and fourth levels higher than said first level and lower than said second level obtained by subjecting said anode voltage to resistance division by using a resistor arranged in the vicinity of said electron gun structure are respectively applied, these electrode being arranged along a traveling direction of said electron beam in the order of said at least one focus electrode, said two auxiliary electrodes, and at least one anode electrode, wherein assuming that an electrode length of a first auxiliary electrode adjacent to said focus electrode among said two auxiliary electrodes is L1, an electrode length of a second auxiliary electrode adjacent to said anode electrode is L2, said focus voltage is Vf, said anode voltage is Eb, a voltage applied to said first auxiliary electrode is Vm1, and a voltage applied to said second auxiliary electrode is Vm2, L1<L2 is achieved when a difference in potential between electrodes arranged in front of and at the rear of said second auxiliary electrode (Eb−Vm1) is larger than a difference in potential between electrodes arranged at front and rear positions in said electron beam traveling direction of said first auxiliary electrode (Vm2−Vf), and L1>L2 is achieved when a difference in potential between electrodes arranged in front of and at the rear of said second auxiliary electrode (Eb−Vm1) is smaller than a difference in potential between electrodes arranged in front of and at the rear of said first auxiliary electrode (Vm2−Vf).

* * * * *